US010492634B2

(12) United States Patent
Beltrami

(10) Patent No.: US 10,492,634 B2
(45) Date of Patent: Dec. 3, 2019

(54) CLOSURE DEVICES FOR CONTAINERS SUITABLE FOR HOLDING LIQUIDS

(71) Applicant: Artsana S.p.A., Grandate (IT)

(72) Inventor: Gianluca Beltrami, Seregno (IT)

(73) Assignee: ARTSANA S.P.A., Grandate (CO) (IT)

( * ) Notice: Subject to any disclaimer, the term of this patent is extended or adjusted under 35 U.S.C. 154(b) by 167 days.

(21) Appl. No.: 15/642,776

(22) Filed: Jul. 6, 2017

(65) Prior Publication Data

US 2018/0008069 A1 Jan. 11, 2018

(30) Foreign Application Priority Data

Jul. 8, 2016 (IT) ..... 102016000071569

(51) Int. Cl.
*A47G 19/22* (2006.01)
*B65D 53/02* (2006.01)

(52) U.S. Cl.
CPC ..... *A47G 19/2272* (2013.01); *B65D 53/02* (2013.01)

(58) Field of Classification Search
CPC ..... A47G 19/2272; B65D 53/02
USPC ..... 215/351, 311; 220/304, 714
See application file for complete search history.

(56) References Cited

U.S. PATENT DOCUMENTS 5,680,951 A 10/1997 Feltman, III et al.
2005/0056653 A1* 3/2005 Miller ..... A47G 19/2272 220/710.5
2006/0045096 A1* 3/2006 Farmer ..... H04L 47/10 370/395.42
2006/0255051 A1 11/2006 Adams
2011/0084084 A1* 4/2011 Berg ..... A47G 19/2272 220/703
2011/0155684 A1* 6/2011 Sirota ..... A61J 9/04 215/11.5
2015/0102032 A1* 4/2015 Dunn ..... A47G 19/2272 220/231

FOREIGN PATENT DOCUMENTS

EP 2265152 B1 12/2010
GB 2461005 B 12/2009
WO 2009126042 A1 10/2009

OTHER PUBLICATIONS

Italian Search Report dated Mar. 28, 2017, in corresponding Italian Application No. IT 201600071569, 7 pages.

* cited by examiner

*Primary Examiner* — James N Smalley
(74) *Attorney, Agent, or Firm* — MH2 Technology Law Group, LLP

(57) ABSTRACT

A closure device for containers suitable for holding liquids may include: a collar adapted to be applied to a neck of a liquid container, the collar having a lip; an elastically deformable membrane, configured to connect to the collar and to close the liquid container, wherein the membrane is configured to rest upon the lip and to define a seal along the lip, and wherein the seal is at least partially releasable by pressure exerted by a mouth of a user; and first and second flanges. The first flange is formed as a single piece with the membrane. The second flange is fixed to the collar to be locked between the first flange and the membrane. The first flange includes: a first portion projecting out of the membrane; and a second portion projecting out of the first portion. The second portion is oriented perpendicularly to the first portion.

20 Claims, 3 Drawing Sheets

CLOSURE DEVICES FOR CONTAINERS SUITABLE FOR HOLDING LIQUIDS

CROSS-REFERENCE TO RELATED APPLICATION(S)

This application claims priority under 35 U.S.C. § 119 from Italian Patent Application No. 102016000071569, filed on Jul. 8, 2016, in the Italian Patent and Trademark Office ("IPTO"), the entire contents of which are incorporated herein by reference.

FIELD OF THE DISCLOSURE

The present disclosure concerns a closure device for containers suitable for holding liquids. Namely, such device is particularly useful for closing a glass, a cup or any other container that is mainly designed for use by children.

BACKGROUND

Closure devices for containers suitable for holding liquids are known in the art. Examples of these devices are disclosed in WO 2009 126 042 A1, an international patent application filed in the name of Gunnar Berg and issued in Europe under no. EP 2 265 152 B.

More in detail, Berg discloses a cup comprising a container and a valve designed to close the container. The valve comprises a main body, attached to the container, and a cut-off member attached to the main body, and external to the container. The cut-off member is defined by a flexible member, which may be deformed by a pressure of the user's lips. Upon such deformation, liquid is free to flow outside the container.

More in detail, the main body of the valve has an anchor portion for the shut-off member, which is located in a central area. Such anchor portion is defined by a flange which projects out of a surface of the main body and located, in operation, substantially within the cup. Furthermore, the flange has slots for the passage of liquid.

According to Berg's teachings, the flange mainly acts as a splash guard, i.e. damps any splashes of liquid from inside the container, caused by vigorous stirring thereof. Thus, any movement of the liquid will impact against the cut-off member with a weaker force, and will not be able to move it.

Further teachings relating to closure devices may be found in GB 2 461 005 B. This document, a patent issued to And Design Ltd. discloses differential pressure valves for closing containers. These valves are very similar in structure to the devices as disclosed by Berg but, unlike the latter, are opened by the user by exerting a suction on the edge of the container where the cut-off member of the valve sealingly rests.

SUMMARY OF THE DISCLOSURE

The devices as disclosed by Berg have the drawback of requiring molding of parts with complex shapes, which involves considerable costs.

Therefore, the technical purpose of the present disclosure is to provide a closure device for containers suitable for holding liquids, that can obviate the above mentioned prior art drawbacks.

Particularly, the object of the present disclosure is to provide a closure device for containers suitable for holding liquids that can allow a child to drink from the container while preventing any undesired leakage of liquids from the container.

A further object of the present disclosure is to find a solution that might constitute an alternative to prior art solutions, and involves lower manufacturing costs.

The aforementioned technical purpose and objects are substantially fulfilled by a closure device for containers suitable for holding liquids that comprises the technical features as disclosed in one or more of the accompanying claims.

Particularly, a closure device for containers suitable for holding liquids according to the disclosure comprises a collar that is adapted to be applied to the neck of a liquid container. Such collar has a lip for a user to withdraw liquid therefrom.

The device further comprises an elastically deformable membrane, which is adapted to be connected to the collar. This membrane is adapted to close the container. Furthermore, this membrane is configured to rest upon the lip of the collar and define a seal along such lip. The seal is designed to be at least partially released by the pressure exerted by the mouth of a user to drink from the container.

The device further comprises lock means for locking the membrane to the collar. The lock means particularly comprise first and second flanges. The first flange is formed as a single piece with the membrane. The second flange is fixed to the collar to be locked between the first flange and the membrane.

This device solves the technical problem, as the seal between the collar lip and the membrane prevents liquid leakages from the container. Furthermore, the seal can be released by the pressure exerted by the lips of a user, for liquid to flow out of the container and for a child to be able to simply drink therefrom. Finally, the shapes of both the collar and the membrane, including their respective flanges, are rather simple and afford considerable savings in the molding process.

LIST OF DRAWINGS

Further features and advantages will result more clearly from the illustrative, non-limiting description of a preferred, non-exclusive embodiment of a closure device for containers suitable for holding liquids, as shown in the annexed drawings, in which.

DETAILED DESCRIPTION

Figure 1:
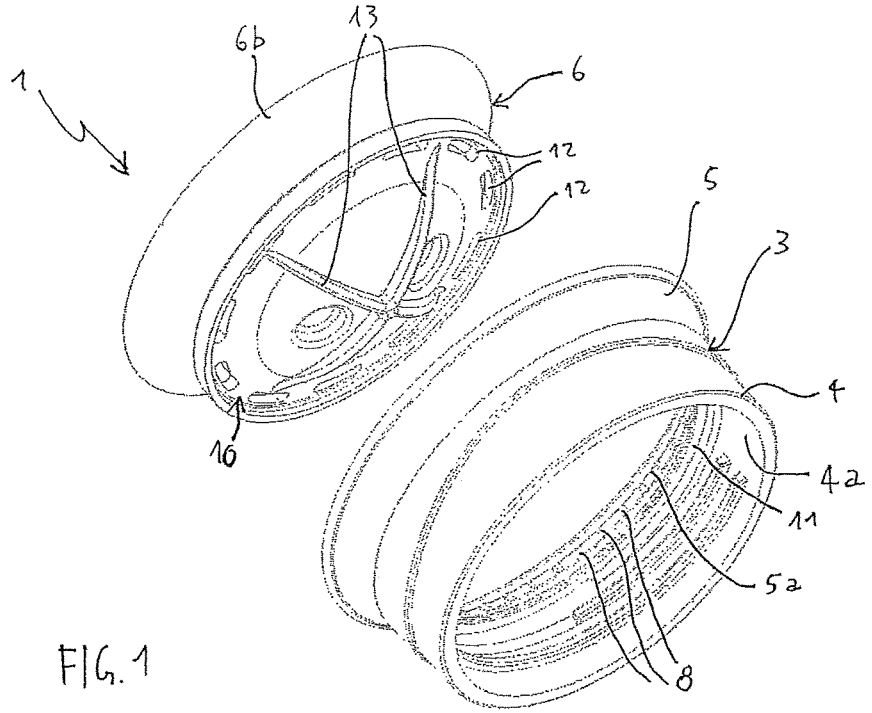
FIG. 1 is an exploded perspective view of a closure device for containers suitable for holding liquids.

Referring to the annexed figures, numeral 1 designates a closure device for containers suitable for holding liquids. The device 1 particularly adapted to be applied to a liquid container 2, e.g. a glass or a cup. This container 2 has a threaded neck 2*a*, which allows the device 1 to be sealingly tightened thereupon, in a manner that will be more clearly explained hereinbelow.

The device 1 comprises a collar 3 that is adapted to be applied to the neck 2*a* of the container 2. Preferably, the collar 3 has a shape that is axisymmetric with respect to its center axis "C".

More in detail, the collar 3 comprises a wall 4. This wall 4 has a substantially cylindrical shape, and has a threaded cylindrical surface 4*a* that allows it to be tightened upon the container 2.

The collar 3 further comprises a lip 5. This lip 5 extends from the wall 4 and is seamless with the wall 4. The lip 5 has a conical shape, particularly diverging outwards from the wall 4. Furthermore, the lip 5 has an inner conical surface 5*a* along which the liquid may flow out of the container 2. It shall be noted that the inner conical surface 5*a* is not limited to a strictly cone shape, and may have any shape whatever provided that it diverges from the wall 4. It shall be further noted that the lip 5 of the collar 3 and the wall 4 are connected and formed as a single piece with each other. In terms of construction, the collar 3 may be made of any suitable material, e.g. polypropylene.

The device 1 also comprises an elastically deformable membrane 6. This membrane 6 is designed to be connected to the collar 3 to close the container 2, once the device 1 is applied to the container 2. Namely, the membrane 3 has a concave-convex shape, i.e. with a concave surface 6*a* that faces, in operation, the external environment, and a convex surface 6*b* that may face the interior of the container and is opposite to the concave surface 6*a*. The membrane 6 may be made of silicone.

Figure 2:
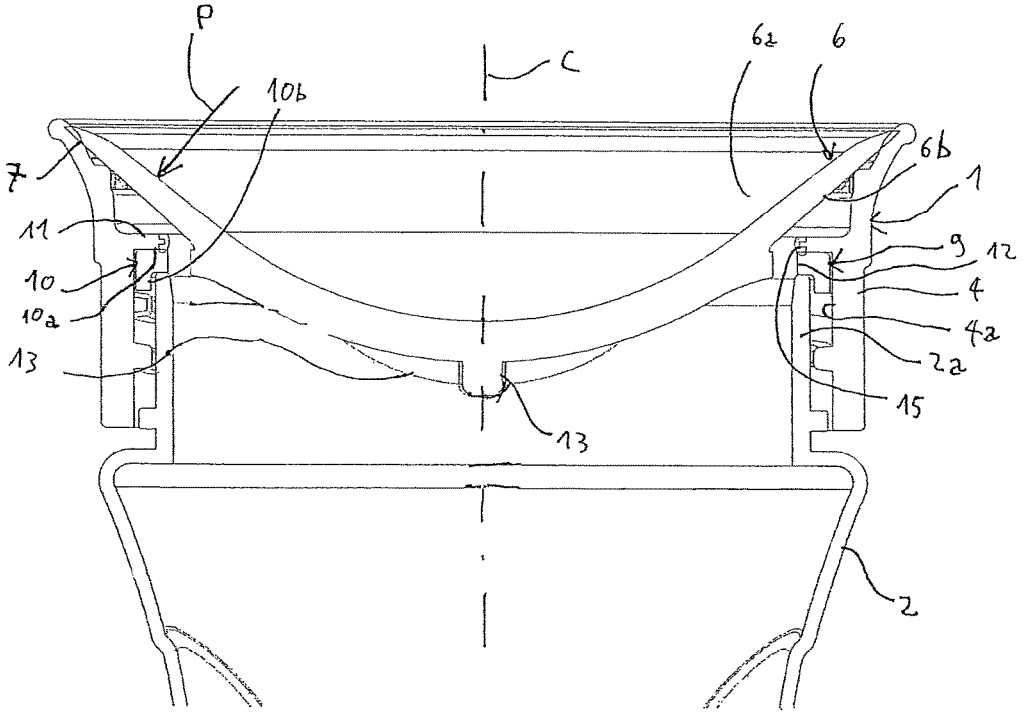
FIG. 2 is a sectional side view of the device of FIG. 1, when applied to a container.
Figure 3:
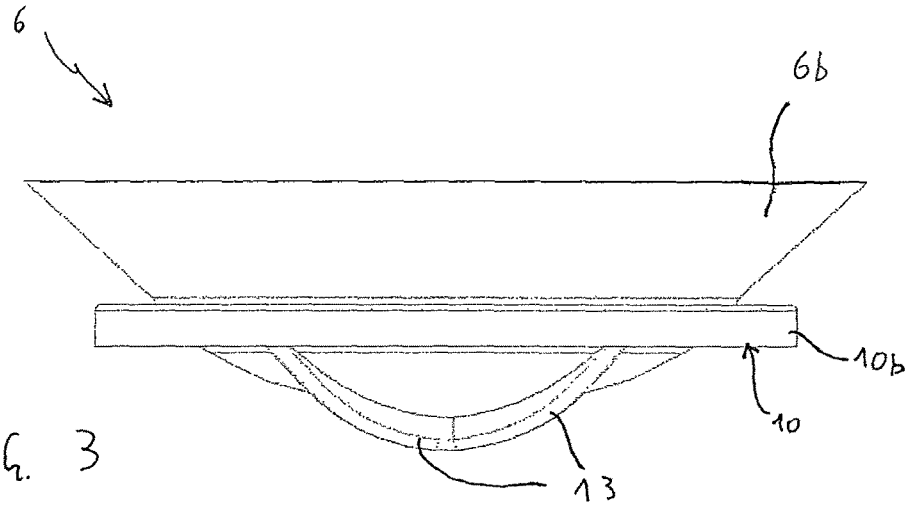
FIG. 3 is a side view of a detail of the device of FIG. 1.

As particularly shown in FIG. 2, the membrane 6 is configured to rest upon the lip 5 of the collar 3, particularly a portion of the convex surface 6*b*, thereby defining a seal 7. Such seal 7 is particularly defined all along the perimeter of the lip 5, and is adapted to be at least partially released by the pressure exerted by the mouth of a user. In other words, a user may press his/her mouth on the concave surface portion 6*a* opposite to the seal 7, such that the membrane 6 will be partially lifted from the lip 5, thereby allowing the liquid in the container 2 to flow out of it.

Figure 5:
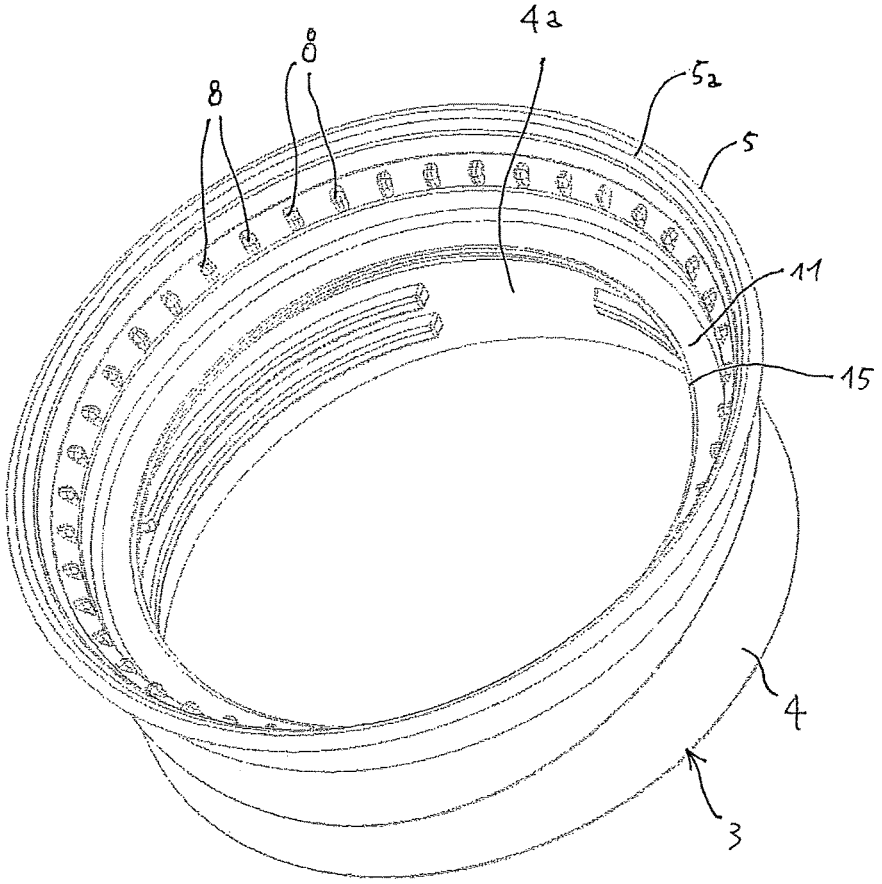
FIG. 5 is a perspective view of a further detail of the device of FIG. 1.

Particularly referring to FIG. 5, the collar 3 comprises a plurality of projections 8 on the inner conical surface 5*a*. In operation, these projections contact the membrane 6, particularly its convex surface 6*b*. As shown in FIG. 2, when a force "P" is applied to the membrane 6, particularly to its concave surface 6*a*, the membrane 6 is pushed against the projections 8 which act as a fulcrum and cause the membrane 6 to lift off the area of the seal 7. This will advantageously allow the user to locally release the seal 7 in an area of the lip 5 at which the user is drinking from the container 2. Also advantageously, the seal 7 maintains its action along the rest of the lip 5, to prevent undesired liquid leakage.

More in detail, the projections 8 are arranged along a circumference and are at equal angular distances from a center axis C of the collar 3. This will advantageously allow the user to drink from any position, as the collar 3, and hence the container 2 with the device 1 applied thereto, have no preferential angular orientation.

According to the present disclosure, the device 1 comprises lock means 9, which are associated with the membrane 6 to lock it to the collar 3. Particularly referring to FIG. 2, the lock means 9 comprise a first flange 10. The first flange 10 is formed as a single piece with the membrane 6.

The lock means 9 further comprises a second flange 11 attached to the collar 3. This second flange 11, in operation, is locked between the first flange 10 and the membrane 6. More in detail, due to the elastic behavior of the membrane 6, once the second flange 11 is positioned, the membrane 6 is partially deformed by simultaneous contact between the two flanges 10, 11 and the by lip 5 with the membrane 6. This deformation will generate an elastic reaction force that will lock the membrane 6 to the collar 3. A further purpose of the second flange 11 is to bias the first flange 10 against an edge of the container 2, particularly once the collar 3 has been tightened on the neck 2*a* of the container 2.

More in detail, the first flange 10 is made of the same material as the rest of the membrane 6. The first flange 10 further comprises a first portion 10*a*, which projects out of the membrane 6, particularly from its convex surface 6*b*. In operation, the first portion 10*a* of the first flange 10 is oriented substantially perpendicular to the wall 4 of the container 2. The first portion 10*a* of the first flange 10 is adapted to be compressed between the second flange 11 and the container 2.

The first flange 10 comprises a second portion 10*b* which preferably perpendicularly projects from the first portion 10*a*, such second portion 10*b* of the first flange 10 being adapted to fit in the gap between the collar 3, particularly the wall 4, and the neck 2*a* of the container 2. This will advantageously ensure fluid-tightness between the collar 3 and the container 2, when the membrane 6 is fitted upon the caller 3.

The first flange 10 has a plurality of slots 12, allowing the passage of the liquid. Particularly, the slots 12 are arranged on the first portion 10*a* of the first flange 10. It may be appreciated that the slots 12 have a much larger surface than the remaining surface of the first portion 10*a* of the first flange 10. By this arrangement, the first flange 10 will advantageously not hinder fluid outflow when the user drinks from the container 2.

It shall be further noted that the first flange 10 does not act as a splash guard, as it is directly connected to the membrane 6. As a result, the force resulting from the impact of a liquid against the first flange 10 will be entirely transferred to the membrane 6. Furthermore, the membrane 6 is directly exposed in the container 2, therefore no element of the device 1 may act as a splash guard for the membrane 6.

Figure 4:
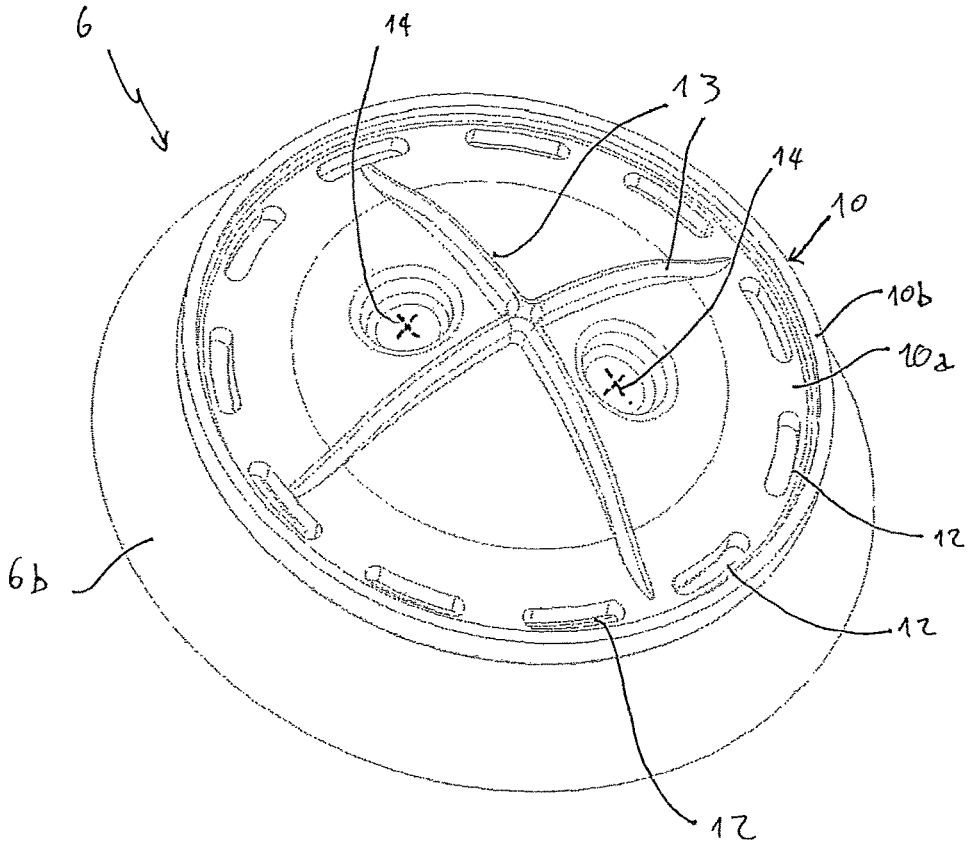
FIG. 4 is a perspective bottom view of the detail of FIG. 3.

The device 1 further comprises at least one rib 13 which is placed on the convex surface 6*a* of the membrane 6 for stiffening purposes. In the embodiment as shown in FIG. 4, the device 1 comprises a pair of ribs 13, which are oriented perpendicular to each other and symmetrically with respect to the center axis "C". Further embodiments may be obviously also possible, in which the ribs 13 may be provided in any number and arrangement. The ribs 13 are formed as a single piece with the membrane 6 and are particularly made of the same material as the membrane 6.

The membrane 6 also preferably has at least one cutout 14 to allow ingress of air during liquid withdrawal. Such cutout 14 is defined by an opening whose edges are in mutual contact, such that the negative pressure created by withdrawal of liquid from the container 2 will allow air ingress while preventing liquid from flowing out of the container 2 in any other condition.

The device 1 further comprises at least one gasket 15 placed on the second flange 11, particularly at an end portion thereof. Advantageously, this gasket 15 is designed to create a direct sealing effect on the container 2 in an alternative configuration of the device 1 (i.e., a configuration in which the membrane 6 is not fitted on the collar 3). More in detail, the gasket 15 is formed with the collar by bi-injection molding. The gasket 15 is preferably formed from thermoplastic elastomer ("TPE").

The invention claimed is:

1. A closure device for containers suitable for holding liquids, the closure device comprising:

a collar adapted to be applied to a neck of a liquid container, the collar having a lip;

an elastically deformable membrane, configured to connect to the collar and to close the liquid container, wherein the membrane is configured to rest upon the lip and to define a seal along the lip, and wherein the seal is at least partially releasable by pressure exerted by a mouth of a user; and lock means configured to lock the membrane to the collar;

wherein the lock means comprises a first flange and a second flange, wherein the first flange is formed as a single piece with the membrane, wherein the second flange is fixed to the collar to be locked between the first flange and the membrane, wherein the first flange comprises:

a first portion projecting out of the membrane; and a second portion projecting out of the first portion;

wherein the second portion is arranged perpendicularly to the first portion, and wherein the second portion is configured to fit in a gap between the collar and the neck of the liquid container.

2. The closure device of claim 1, further comprising a plurality of slots on the first flange to allow a liquid to flow therethrough.

3. The closure device of claim 1, wherein the lip has an inner tapered surface, and wherein the collar comprises a plurality of projections arranged on the inner tapered surface.

4. The closure device of claim 3, wherein the projections are arranged along a circumference of the inner tapered surface, and wherein the projections are at equal angular distances from a center axis of the collar.

5. The closure device of claim 1, wherein the membrane and the first flange are made of silicone.

6. The closure device of claim 1, further comprising:

at least one rib on a convex surface of the membrane to stiffen the membrane.

7. The closure device of claim 6, wherein the at least one rib is formed as a single piece with the membrane.

8. The closure device of claim 1, wherein the membrane has at least one cutout to allow ingress of air during liquid withdrawal from the liquid container.

9. The closure device of claim 1, further comprising:

a gasket;

wherein the gasket is placed on the second flange, and wherein the gasket is configured to push the first flange against an edge of the liquid container.

10. The closure device of claim 9, wherein the gasket and the collar are formed by bi-injection molding.

11. A kit, comprising:

the closure device of claim 1; and a liquid container configured to receive the closure device and to be closed by the closure device.

12. The closure device of claim 3, wherein the projections are arranged along a circumference of the collar, and wherein the projections are at equal angular distances from a center axis of the collar.

13. The closure device of claim 9, wherein the gasket is formed from thermoplastic elastomer (TPE).

14. The closure device of claim 1, wherein the membrane has a concave surface, and wherein the concave surface is configured to face an external environment.

15. The closure device of claim 1, wherein the membrane has a convex surface, and wherein the convex surface is configured to face an interior of the liquid container.

16. The closure device of claim 1, wherein the membrane has a concave surface and a convex surface opposite to the concave surface, wherein the concave surface is configured to face an external environment, and wherein the convex surface is configured to face an interior of the liquid container.

17. The closure device of claim 6, further comprising:

an additional rib on the convex surface of the membrane;

wherein the additional rib is perpendicular to the at least one rib.

18. The closure device of claim 1, further comprising:

a plurality of ribs on a convex surface of the membrane to stiffen the membrane.

19. A closure device for containers suitable for holding liquids, the closure device comprising:

a collar adapted to be applied to a neck of a liquid container, the collar having a lip;

an elastically deformable membrane, configured to connect to the collar and to close the liquid container, wherein the membrane is configured to rest upon the lip and to define a seal along the lip, and wherein the seal is at least partially releasable by pressure exerted by a mouth of a user; and a first flange and a second flange;

wherein the first flange is formed as a single piece with the membrane, wherein the second flange is fixed to the collar to be locked between the first flange and the membrane, wherein the first flange comprises:

a first portion projecting out of the membrane; and a second portion projecting out of the first portion; and wherein the second portion is oriented perpendicularly to the first portion.

20. A closure device for containers suitable for holding liquids, the closure device comprising:

a collar adapted to be applied to a neck of a liquid container, the collar having a lip;

an elastically deformable membrane, configured to connect to the collar and to close the liquid container, wherein the membrane is configured to rest upon the lip and to define a seal along the lip, and wherein the seal is at least partially releasable by pressure exerted by a mouth of a user; and a first flange and a second flange;

wherein the first flange is formed as a single piece with the membrane, wherein the second flange is fixed to the collar to be locked between the first flange and the membrane, wherein the first flange comprises:

a first portion projecting out of the membrane; and a second portion projecting out of the first portion;

wherein the first portion has a plurality of slots, wherein the first portion at least partially extends radially outward from the slots, and wherein the second portion is oriented perpendicularly to the first portion.

* * * * *